US010046196B2

(12) United States Patent
Ercanbrack et al.

(10) Patent No.: US 10,046,196 B2
(45) **Date of Patent: *Aug. 14, 2018**

(54) PEDAL PATH OF A STEPPING MACHINE

(71) Applicant: ICON Health & Fitness, Inc., Logan, UT (US)

(72) Inventors: Gaylen Ercanbrack, Logan, UT (US); Michael L. Olson, Providence, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/246,012

(22) Filed: Aug. 24, 2016

(65) Prior Publication Data

US 2017/0056717 A1 Mar. 2, 2017

Related U.S. Application Data

(60) Provisional application No. 62/211,210, filed on Aug. 28, 2015.

(51) Int. Cl.
*A63B 22/00* (2006.01)
*A63B 22/06* (2006.01)
(Continued)

(52) U.S. Cl.
CPC ..... *A63B 22/0664* (2013.01); *A63B 21/0085* (2013.01); *A63B 21/225* (2013.01);
(Continued)

(58) Field of Classification Search
None
See application file for complete search history.

(56) References Cited

U.S. PATENT DOCUMENTS 5,013,031 A 5/1991 Bull
5,048,824 A * 9/1991 Chen ..... A63B 21/0088 434/247
(Continued)

FOREIGN PATENT DOCUMENTS

TW 200819164 5/2008
TW I311066 6/2009
TW I469809 1/2015

OTHER PUBLICATIONS

Written Opinion and Search Report issued in PCT/US2016/048717 dated Nov. 1, 2016.
(Continued)

*Primary Examiner* — Stephen R Crow
(74) *Attorney, Agent, or Firm* — Ray Quinney & Nebeker

(57) ABSTRACT

A vertical stepping machine includes a frame, a crank wheel connected to the frame, a crank wheel connected to the frame, a pedal beam having a first end and a second end, wherein the first end is in mechanical communication with the crank wheel, a pedal connected to the second end of the pedal beam, a linkage assembly connected to the frame and to the pedal beam, an arm support rotatably connected to the frame, an arm linkage connecting the arm support to the linkage assembly, and a rotary resistance mechanism positioned above the crank wheel when the vertical stepping machine is in an upright orientation. The pedal beam moves in an elliptical path when the crank wheel rotates and the elliptical path has a vertical major axis and a horizontal minor axis when the vertical stepping machine is in an upright position.

20 Claims, 10 Drawing Sheets

(51) Int. Cl.
*A63B 21/008* (2006.01)
*A63B 21/22* (2006.01)
*A63B 21/00* (2006.01)
*A63B 23/035* (2006.01)

(52) U.S. Cl.
CPC ..... *A63B 21/4034* (2015.10); *A63B 21/4035* (2015.10); *A63B 23/03516* (2013.01); *A63B 2022/0676* (2013.01)

(56) References Cited

U.S. PATENT DOCUMENTS 5,242,343 A 9/1993 Miller
5,290,211 A 3/1994 Stearns
5,383,829 A 1/1995 Miller
5,499,956 A 3/1996 Habing et al.
5,529,555 A * 6/1996 Rodgers, Jr. ..... A63B 22/001 482/51
5,540,637 A 7/1996 Rodgers, Jr.
5,577,985 A * 11/1996 Miller ..... A63B 21/00178 482/51
5,593,372 A * 1/1997 Rodgers, Jr. ..... A63B 22/001 482/51
5,653,662 A * 8/1997 Rodgers, Jr. ..... A63B 22/001 482/51
5,795,270 A * 8/1998 Woods ..... A63B 21/0088 482/62
5,997,445 A * 12/1999 Maresh ..... A63B 22/001 482/51
6,024,676 A * 2/2000 Eschenbach ..... A63B 22/001 482/51
6,080,086 A 6/2000 Maresh et al.
6,099,439 A 8/2000 Ryan et al.
6,196,948 B1 3/2001 Stearns et al.
6,422,977 B1 7/2002 Eschenbach
6,994,656 B2 2/2006 Liao et al.
7,201,705 B2 * 4/2007 Rodgers, Jr. ..... A63B 22/001 482/52
7,238,146 B1 * 7/2007 Chen ..... A63B 22/001 482/52
7,377,881 B2 5/2008 Moon
7,455,624 B2 * 11/2008 Liao Lai ..... A63B 22/001 482/51
7,556,591 B2 * 7/2009 Chuang ..... A63B 22/001 482/51
7,591,761 B1 * 9/2009 Ellis ..... A63B 21/22 482/52
7,611,446 B2 * 11/2009 Chuang ..... A63B 22/0015 482/52
7,618,350 B2 * 11/2009 Dalebout ..... A63B 22/001 482/52
7,736,278 B2 6/2010 Lull et al.
7,811,206 B2 * 10/2010 Chuang ..... A63B 22/001 482/52
8,092,352 B2 1/2012 Irving et al.
8,926,478 B2 * 1/2015 Huang ..... A63B 22/001 482/51
9,199,115 B2 * 12/2015 Yim ..... A63B 22/001
9,468,797 B1 * 10/2016 Miller ..... A63B 22/001
2001/0011053 A1 8/2001 Miller
2005/0181911 A1 * 8/2005 Porth ..... A63B 22/001 482/52
2006/0079381 A1 * 4/2006 Cornejo ..... A63B 22/0007 482/52
2006/0293153 A1 * 12/2006 Porth ..... A63B 22/001 482/52
2007/0117683 A1 * 5/2007 Ercanbrack ..... A63B 22/001 482/52
2007/0149364 A1 6/2007 Blau et al.
2009/0011904 A1 * 1/2009 Chuang ..... A63B 22/001 482/52
2010/0167877 A1 * 7/2010 Grind ..... A63B 22/001 482/52
2013/0012363 A1 * 1/2013 Eschenbach ..... A63B 21/00069 482/52
2014/0148311 A1 5/2014 Eschenbach
2014/0243157 A1 8/2014 Huang et al.
2014/0248998 A1 * 9/2014 Lu ..... A63B 21/154 482/52
2014/0274575 A1 9/2014 Yim et al.

OTHER PUBLICATIONS

English Translation of Taiwan First Office Action and Search Report issued for 105127414 dated Aug. 2, 2017.
English Translation via Orbit.com of the Abstract of TWI311066. Jun. 21, 2009.

* cited by examiner

PEDAL PATH OF A STEPPING MACHINE

CROSS-REFERENCE TO RELATED APPLICATIONS

This application claims priority to U.S. Provisional Patent Application No. 62/211,210, filed on Aug. 28, 2015, entitled PEDAL PATH OF A STEPPING MACHINE, which application is incorporated herein by reference in its entirety.

BACKGROUND

Aerobic exercise is a popular form of exercise that improves one's cardiovascular health by reducing blood pressure and providing other benefits to the human body. Aerobic exercise generally involves low intensity physical exertion over a long duration of time. Generally, the human body can adequately supply enough oxygen to meet the body's demands at the intensity levels involved with aerobic exercise. Popular forms of aerobic exercise include running, jogging, swimming, and cycling among others activities. In contrast, anaerobic exercise often involves high intensity exercises over a short duration of time. Popular forms of anaerobic exercise include strength training and short distance running.

Many choose to perform aerobic exercises indoors, such as in a gym or their home. Often, a user will use an aerobic exercise machine to have an aerobic workout indoors. One such type of aerobic exercise machine is stepping machine, which often includes foot supports that move along generally vertical arcuate paths when moved by the feet of a user. Other popular exercise machines that allow a user to perform aerobic exercises indoors include treadmills, rowing machines, elliptical trainers, and stationary bikes to name a few.

One type of stepping machine is disclosed in U.S. Patent Publication No. 2014/0274575 issued to Rasmey Yim, et al., (hereinafter "the '575 Publication"). In this reference, embodiments of stationary exercise machines are described as having reciprocating foot and/or hand members, such as foot pedals that move in a closed loop path. The '575 Publication, abstract. Some embodiments can include reciprocating foot pedals that cause a user's feet to move along a closed loop path that is substantially inclined, such that the foot motion simulates a climbing motion more than a flat walking or running motion. Id. Some embodiments are described as including reciprocating handles that are configured to move in coordination with the foot via a linkage to a crank wheel also coupled to the foot pedals. Id. Variable resistance can be provided via a rotating air-resistance based mechanism, via a magnetism based mechanism, and/or via other mechanisms, one or more of which can be rapidly adjustable while the user is using the machine. Id. According to this reference, traditional stationary exercise machines include stair climber-type machines and elliptical running-type machines. The '575 Publication, para. [0003]. Each of these types of machines typically offers a different type of workout, with stair climber-type machines providing for a lower frequency vertical climbing simulation, and with elliptical machines providing for a higher frequency horizontal running simulation. Id. Other types of exercise machines are disclosed in U.S. Pat. No. 5,242,343 to Miller; U.S. Pat. No. 5,499,956 to Miller; U.S. Pat. No. 5,540,637 to Rodgers; U.S. Pat. No. 5,573,480 to Rodgers; U.S. Pat. No. 5,683,333 to Rodgers; U.S. Pat. No. 5,938,567 to Rodgers; and U.S. Pat. No. 6,080,086 to Maresh. These references are incorporated herein by reference for all that they disclose.

SUMMARY

In one embodiment of the invention, a vertical stepping machine includes a frame, a crank wheel connected to the frame, a crank wheel connected to the frame, a pedal beam having a first end and a second end, wherein the first end is in mechanical communication with the crank wheel, a pedal connected to the second end of the pedal beam, a linkage assembly connected to the frame and to the pedal beam, an arm support rotatably connected to the frame, an arm linkage connecting the arm support to the linkage assembly, and a rotary resistance mechanism positioned above the crank wheel when the vertical stepping machine is in an upright orientation. The pedal beam moves in an elliptical path when the crank wheel rotates and the elliptical path has a vertical major axis and a horizontal minor axis when the vertical stepping machine is in an upright position.

The rotary resistance mechanism may include a flywheel.

The rotary resistance mechanism may include at least one fan blade.

The linkage assembly may include a second linkage member connected to first linkage member at a pivot where the first linkage member connects to the pedal beam and the second linkage member connects to the frame at a fixed frame location.

The first linkage member may be longer than the second linkage member.

The pedal beam and a first linkage member of the linkage assembly may be fixed with respect to one another.

The vertical stepping machine may include an arm linkage member that directs movement of support arms connects along a length of the first linkage member at a pivot connection and is transverse to the first linkage member.

The vertical stepping machine may include an inclined track connected to the frame and a roller connected to an underside of the pedal beam. The roller may ride along the inclined track as the pedal beam moves along the elliptical path.

The frame may be rotatably connected to a base structure.

The vertical stepping machine may include an axial extension member that connects to the base structure and to the frame changes an incline of the vertical stepping machine when the axial extension member is actuated to change its longitudinal axis.

The rotary resistance mechanism may include at least on illuminated feature.

In one embodiment of the invention, a vertical stepping machine includes a frame, a crank wheel connected to the frame, a pedal beam in mechanical communication with the crank wheel, a linkage assembly connected to the frame and to the pedal beam, the linkage assembly comprises a second linkage member connected to first linkage member at a pivot where the first linkage member connects to the pedal beam and the second linkage member connects to the frame at a fixed frame location, the pedal beam and the first linkage member are fixed with respect to one another, and a rotary resistance mechanism positioned above the crank wheel when the vertical stepping machine is in an upright orientation. The pedal beam moves in an elliptical path when the crank wheel rotates, the elliptical path having a vertical major axis and a horizontal minor axis when the vertical stepping machine is in an upright position.

The rotary resistance mechanism may include a flywheel.

The rotary resistance mechanism may include at least one fan blade.

The vertical stepping machine may further include an inclined track connected to the frame and a roller connected to an underside of the pedal beam. The roller rides along the inclined track as the pedal beam moves along the elliptical path.

The vertical stepping machine may include an arm linkage member that directs movement of support arms connects along a length of the first linkage member at a pivot connection and is transverse to the first linkage member.

The frame may be rotatably connected to a base structure.

The vertical stepping machine may include an axial extension member that connects to the base structure and to the frame changes an incline of the vertical stepping machine when the axial extension member is actuated to change its longitudinal axis.

The rotary resistance mechanism may include at least on illuminated feature.

In one embodiment of the invention, a vertical stepping machine may include a base, a frame rotatably connected to the base, a crank wheel connected to the frame, a pedal beam in mechanical communication with the crank wheel, a linkage assembly connected to the frame and to the pedal beam, the linkage assembly comprises a second linkage member connected to first linkage member at a pivot where the first linkage member connects to the pedal beam and the second linkage member connects to the frame at a fixed frame location, the pedal beam and the first linkage member are fixed with respect to one another, a rotary resistance mechanism positioned above the crank wheel when the vertical stepping machine is in an upright orientation, at least one illuminated feature incorporated into the rotary resistance mechanism, an axial extension member connects to base structure and to the frame changes an incline of the vertical stepping machine when the axial extension member is actuated to change its longitudinal axis, and an arm linkage member that directs movement of support arms connects along a length of the first linkage member at a pivot connection and is transverse to the first linkage member. The pedal beam moves in an elliptical path when the crank wheel rotates, the elliptical path having a vertical major axis and a horizontal minor axis when the vertical stepping machine is in an upright position.

BRIEF DESCRIPTION OF THE DRAWINGS

The accompanying drawings illustrate various embodiments of the present apparatus and are a part of the specification. The illustrated embodiments are merely examples of the present apparatus and do not limit the scope thereof.

Throughout the drawings, identical reference numbers designate similar, but not necessarily identical, elements.

DETAILED DESCRIPTION

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. For purposes of this disclosure, the term "fixed location" refers to a location that does not move with respect to the frame of the exercise machine. For example, a member that is directly attached to the frame of the exercise machine is attached at a fixed location as long as the location to where the member and the frame connect does not change. A member may be pivotally attached to a fixed location as long as the pivot about which the member moves stay in the same place. In contrast, a member that is connected to a wheel that rotates is not a fixed location because as the wheel rotates the connection point between the wheel and the member with respect to the frame, although the location with respect to the wheel stays the same. Likewise, a member that is connected to track where the member can travel along the track does not constitute a fixed location because of the relative movement between the member and the frame. For purposes of this disclosure, a "rigid connection" refers to a connection between two objects where the two objects to do move with respect to each other. For example, a rigid connection excludes a connection where the objects slide in relation to each other or where the objects pivot with respect to each other.

Figure 1:
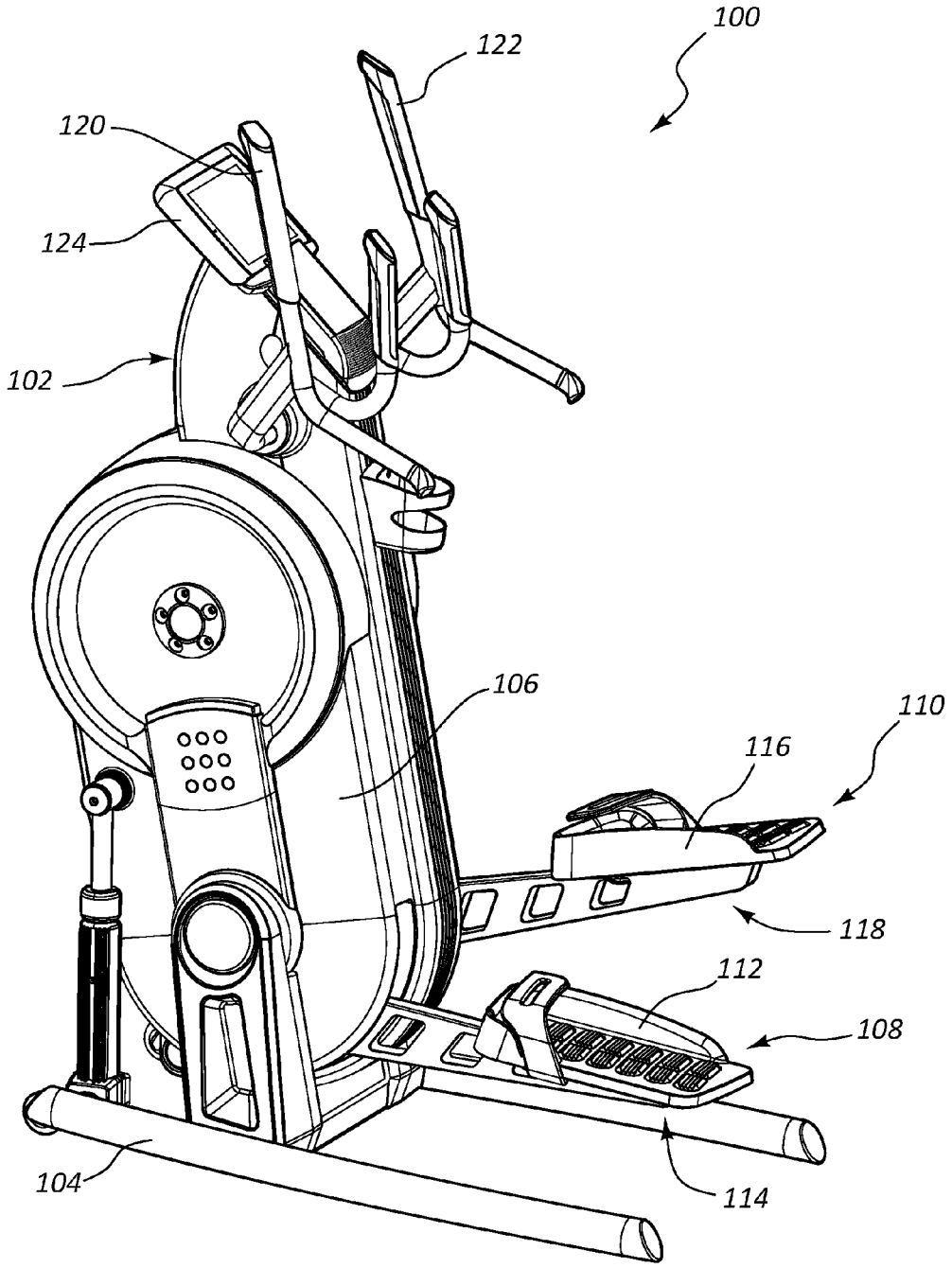
FIG. 1 illustrates a perspective view of an example of a stepping machine in accordance with the present disclosure.

Particularly, with reference to the figures, FIG. 1 depicts an example of an exercise machine 100, such as a vertical stepping machine or another type of exercise machine. The exercise machine 100 includes a frame 102 attached to a base 104. At least a portion of the frame 102 is covered by an outer covering 106, which hides at least some of the internal components of the exercise machine 100.

The exercise machine 100 includes a first pedal beam 108 and a second pedal beam 110 extending from the outer covering 106. A first pedal 112 is attached to a first free end 114 of the first pedal beam 108, and a second pedal 116 is attached to a second free end 118 of the second pedal beam 110. The first and second pedals 112, 116 are shaped and positioned to receive feet of a user. As the user moves his feet while standing on the first and second pedals 112, 116, the first and second pedals 112, 116 move in a generally elliptical path.

The exercise machine 100 also includes a first arm support 120 and a second arm support 122 which are positioned within a convenient arm reach from the user while he or she stands on the first and second pedals 112, 116. A console 124 is positioned between the first and second arm supports 120, 122. A first extendable member 126 is connected to the frame 102 and the base 104, and a second extendable member (which is obscured from view) is also attached to the frame 102 and to the base 104.

Figure 2:
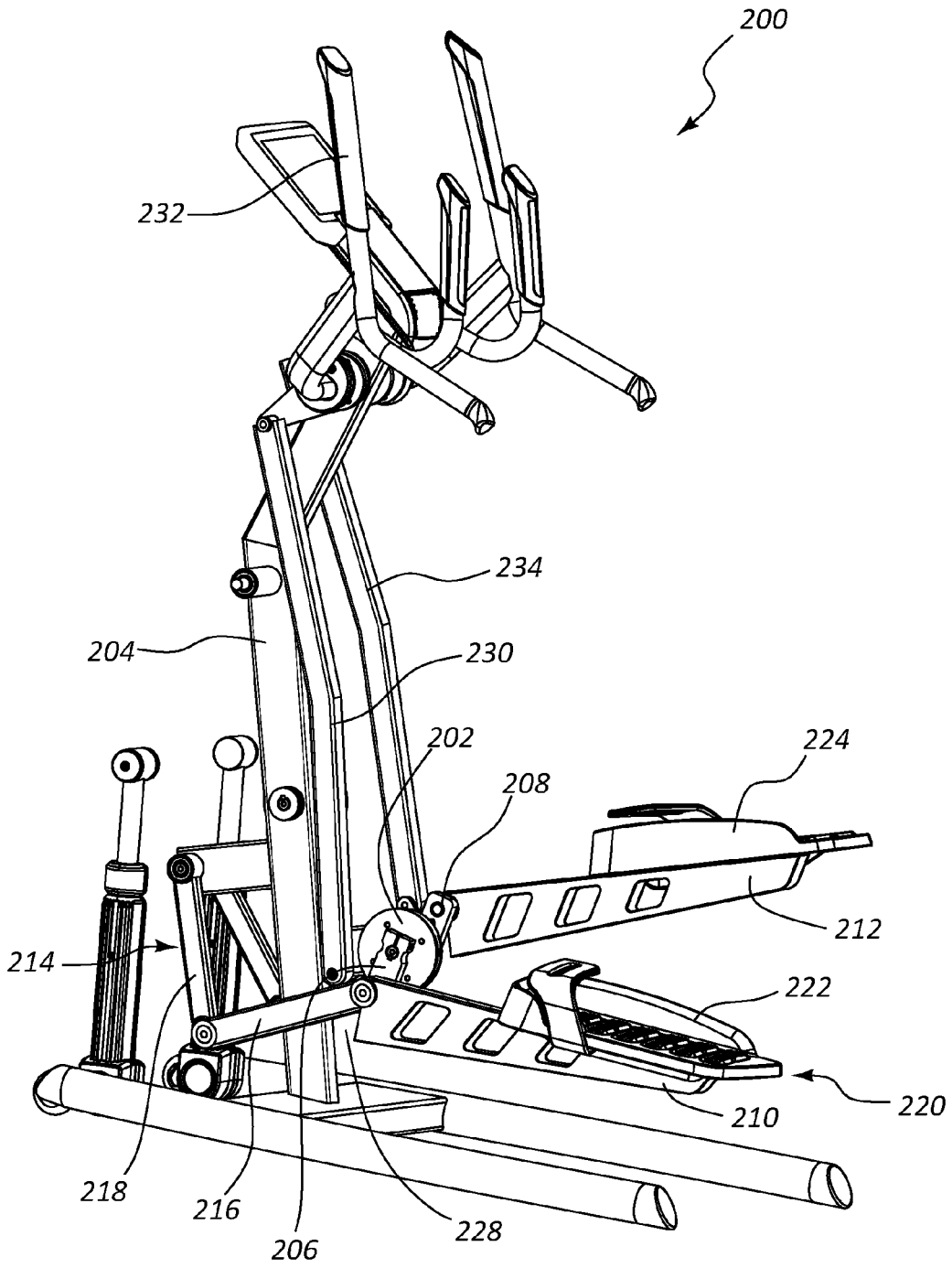
FIG. 2 illustrates a perspective view of an example of the exercise machine without an outer covering and other components for illustrative purposes in accordance with the present disclosure.
Figure 3:
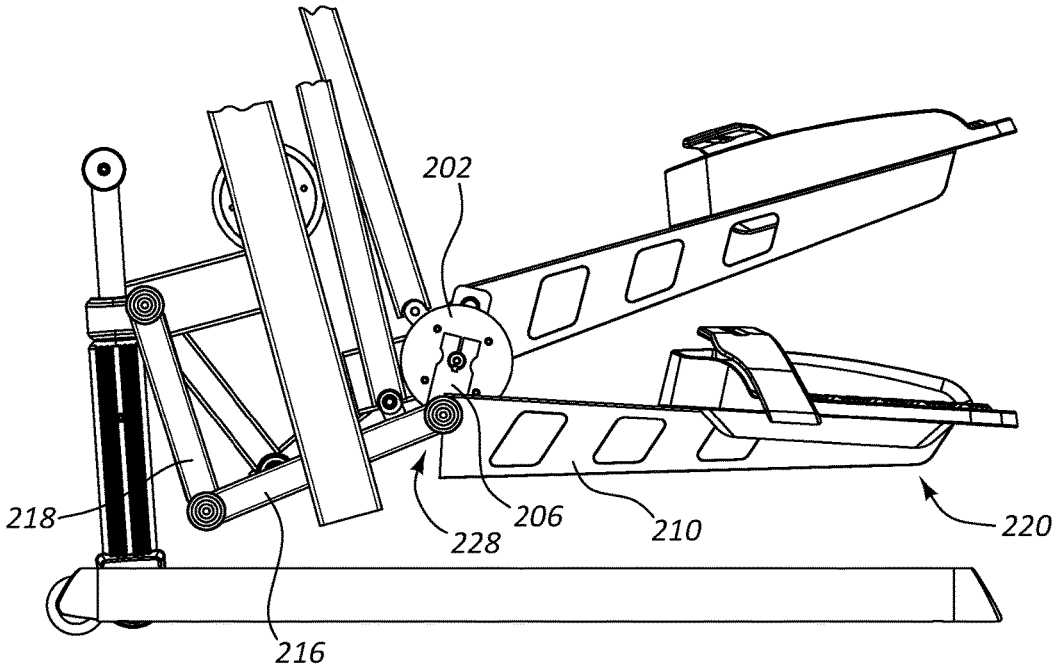
FIG. 3 illustrates a side view of an example of a crank assembly without an outer covering and other components for illustrative purposes in accordance with the present disclosure.

FIGS. 2 and 3 depict an exercise machine 200 without a covering and other internal components of the exercise machine 200 for illustrative purposes. In this example, a crank wheel 202 is attached to the frame 204. The crank wheel 202 includes a first crank arm 206 and a second crank arm 208. The first crank arm 206 is attached to the first pedal beam 210, and the second crank arm 208 is attached to the second pedal beam 212. The first crank arm 206 is attached to first pedal beam 210, and the second crank arm 208 is attached to the second pedal beam 212. Rotation of the crank wheel 202 causes the first and second pedal beams 210, 212 to move in a generally vertical direction.

A linkage assembly 214 also influences the path of the first and second pedal beams 210, 212. A first linkage member 216 of the linkage assembly 214 is connected to the first crank arm 206. While the first linkage member 216 and first crank arm 206 move relative to each other as the crank wheel 202 rotates, the first linkage member 216 is stationary with respect to the first pedal beam 210. Thus, as the crank wheel 202 moves, the first linkage member 216 and the first pedal beam 210 remain in a fixed orientation relative to each other. A second linkage member 218 is connected to the first linkage member 216 and also directly connected to the frame 204. In this example, the second linkage member 218 is shorter than the first linkage member 216. The second linkage member 218 restrains the movement of the first linkage member 216 as the crank wheel 202 moves. As a result, the angular orientation of the first linkage member 216 changes as the crank wheel 202 rotates causing the angular orientation of the first pedal beam 210 relative to an axis of rotation of the crank wheel 202 or to the frame 204 to change as the crank wheel 202 rotates. This causes first pedal beam 210 to change its angular orientation relative to the ground as the first pedal beam 210 moves. With the first end of the first pedal beam 210 constrained with its attachment to the first crank arm 206, the free end 220 of the first pedal beam 210 is caused to move higher and lower than the free end 220 would otherwise move due to the first pedal beam's changing angular orientation.

The first pedal 222 is attached to the first free end of the first pedal beam 210 and the second pedal 224 is attached to the free end of the second free end of the second pedal beam 212. The constrained movement of a front end 228 of the first pedal beam 210 causes the free end 220 and thereby the first pedal 222 to move in an elliptical path as the crank wheel 202 moves. The elliptical path has a major axis that is generally vertical and a minor axis that is generally horizontal.

A first arm linkage member 230 is attached to the first linkage member 216 along a length of the first linkage member 216. In this example, the arm linkage member 230 is attached along the length, but still close to the end of the first linkage member 216 proximate to the first crank arm 206. Further, the arm linkage member 230 is connected to the first linkage member 216 in a transverse orientation. The first arm linkage member 230 extends towards to the first arm support 232. The first arm linkage member 230 is connected to a second arm linkage 234 at a pivot. The second arm linkage member 232 connects to the first arm support 232. As the crank wheel 202 moves, the first and second arm linkage members 230, 234 cause the first arm support 232 to move in a reciprocating arcuate path.

Figure 4:
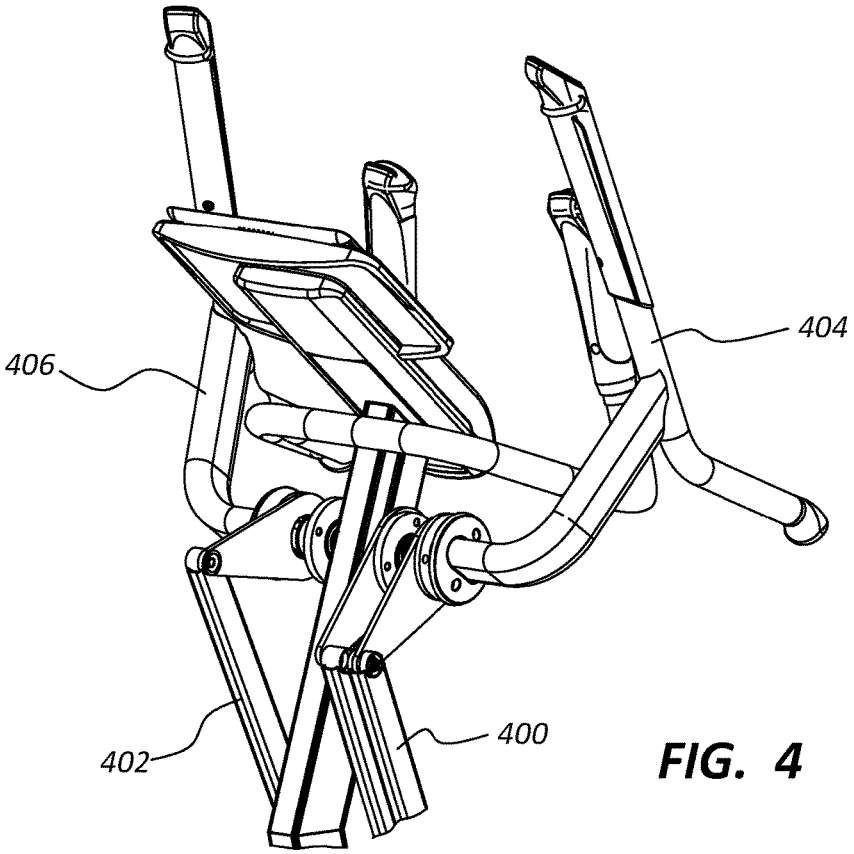
FIG. 4 illustrates a perspective view of an example of swing arms of an exercise machine without an outer covering and other components for illustrative purposes in accordance with the present disclosure.

FIG. 4 depicts an example of a first arm linkage 400 connecting to a second arm linkage 402. The second arm linkage 402 is connected to the first arm support 404. As the first arm linkage 400 is moved by the rotation of the crank wheel, the first arm support 404 moved in a reciprocating motion. Similarly, the second arm support 406 is moved in a reciprocating motion by the arm linkage assembly on the other side of the exercise machine.

Figure 5:
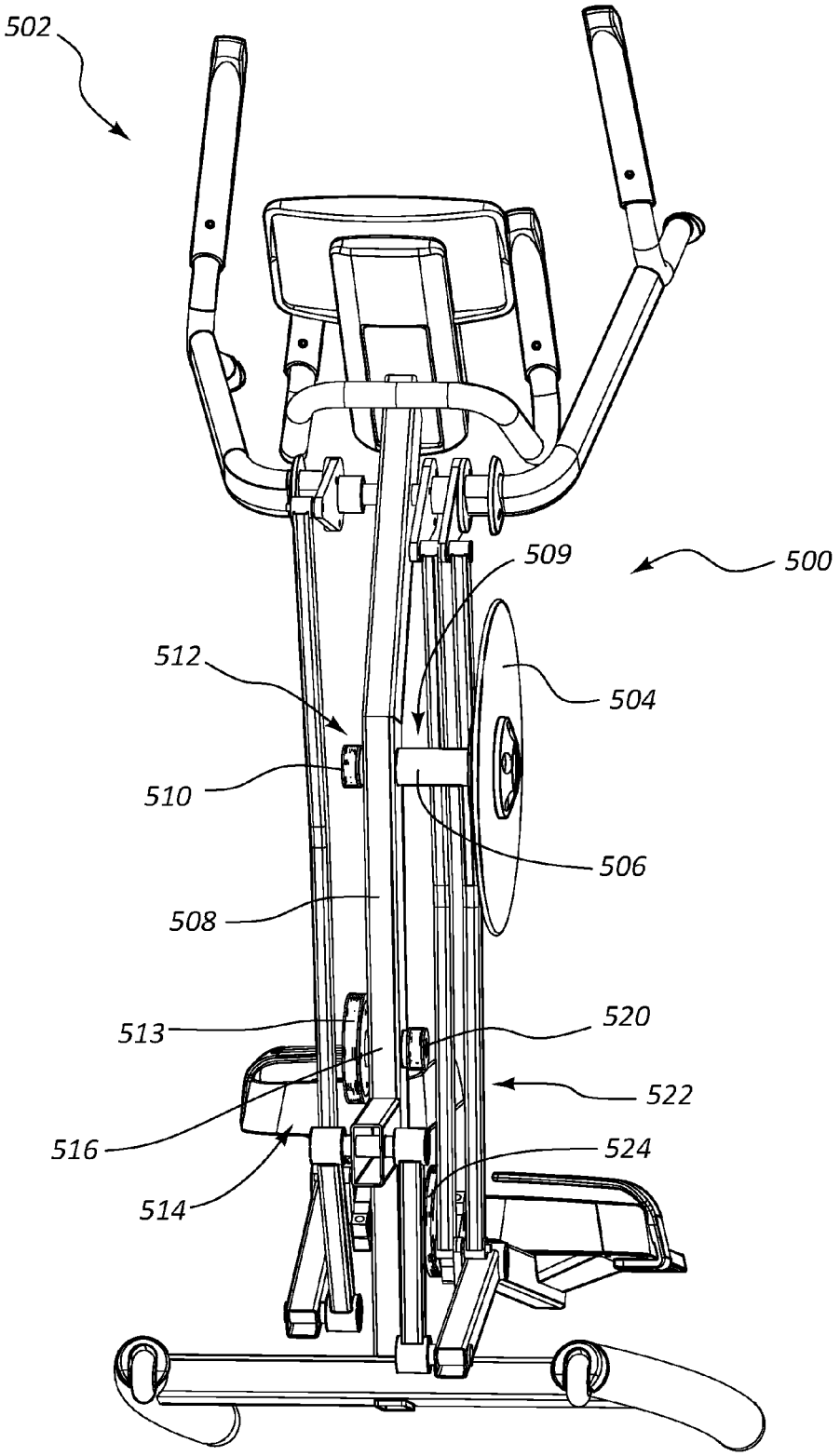
FIG. 5 illustrates a perspective view of an example of a resistance assembly of an exercise machine without an outer covering and other components for illustrative purposes in accordance with the present disclosure.

FIG. 5 depicts an example of a resistance mechanism 500 of the exercise machine 502. In this example, the resistance mechanism 500 is a rotary resistance mechanism, like a flywheel 504. However, disc pads, rotary fans, or other types of rotary resistance mechanisms may be used in accordance with the principles described in the present disclosure. In the depicted example, the flywheel 504 is connected to a flywheel axle 506 that is connected to the frame 508. The flywheel 504 is connected to a first end 509 of the flywheel axle 506 and the first pulley wheel 510 is connected to a second end 512 of the flywheel axle 506. The first pulley wheel 510 is in communication with a second pulley wheel 513 with a first belt (not depicted in FIG. 5 for illustrative purposes).

The second pulley wheel 513 is connected to a first end 514 of a pulley axle 516 that is rotationally connected to the frame 508 of the exercise machine 502. A third pulley wheel 520 is connected to the pulley axle 516 at a second end 522. The third pulley wheel 520 is in communication with the crank wheel 524 with a second belt (also not depicted for illustrative purposes). Thus, as the crank wheel 524 rotates, the first and second belts also rotate causing each of the pulley wheels to rotate as well as the flywheel 510 or other type of rotary resistance mechanism.

Figure 6A:
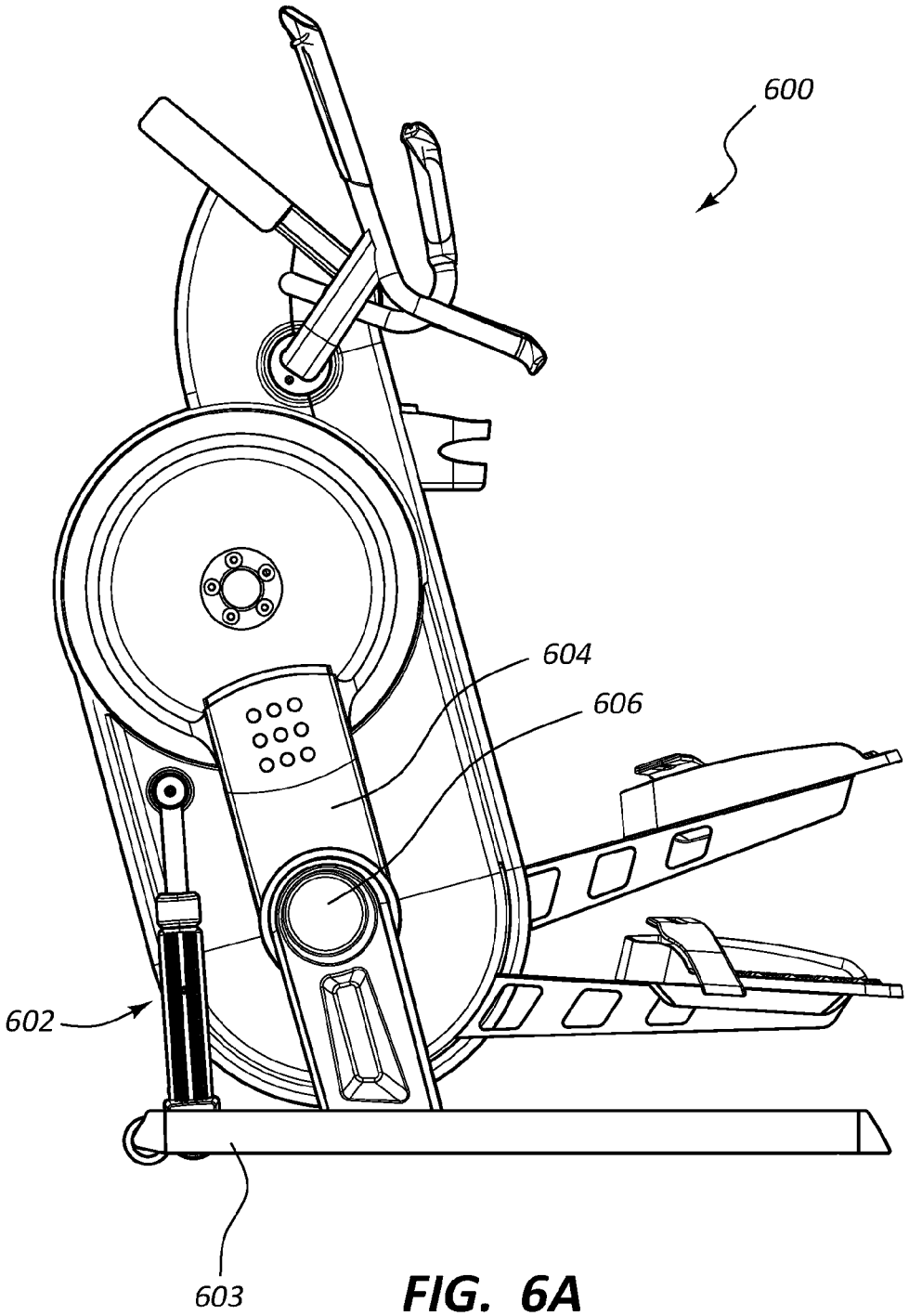
FIG. 6A illustrates a perspective view of an example of an exercise machine in an inclined position in accordance with the present disclosure.
Figure 6B:
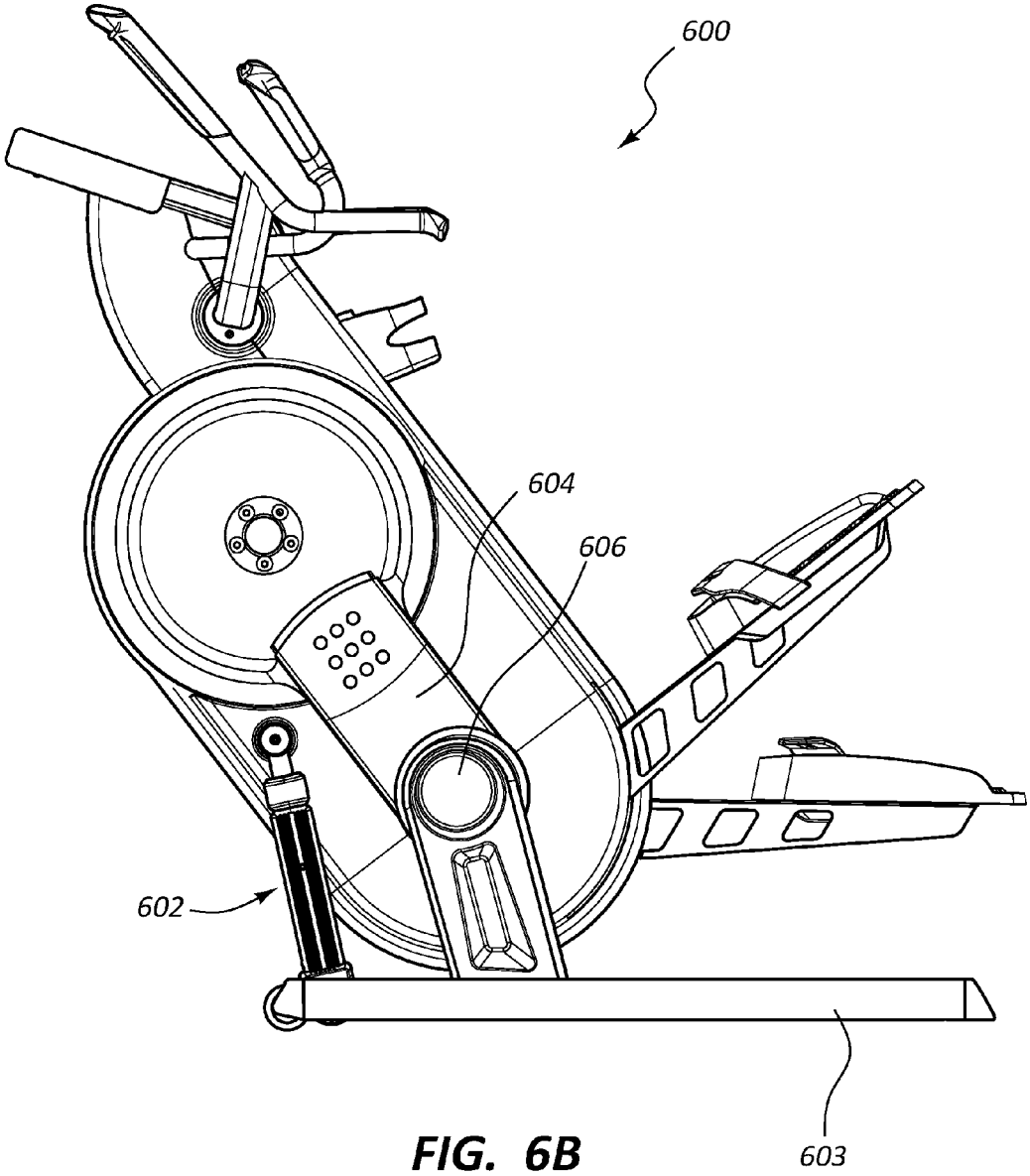
FIG. 6B illustrates a perspective view of an example of an exercise machine in an inclined position in accordance with the present disclosure.

FIGS. 6A and 6B depict an example of the exercise machine 600 in an inclined position. An extendable member 602 is connected to a base 603 of the exercise machine 600 and to the exercise machine's frame 604. The frame 604 is supported by a central axle 606 such that when the extendable member 602 changes its length, the frame 604 rotates about the central axle 606. Thus, the difficulty of a workout performed on the exercise machine 600 may be altered by the length of the extendable member 602.

Figure 7:
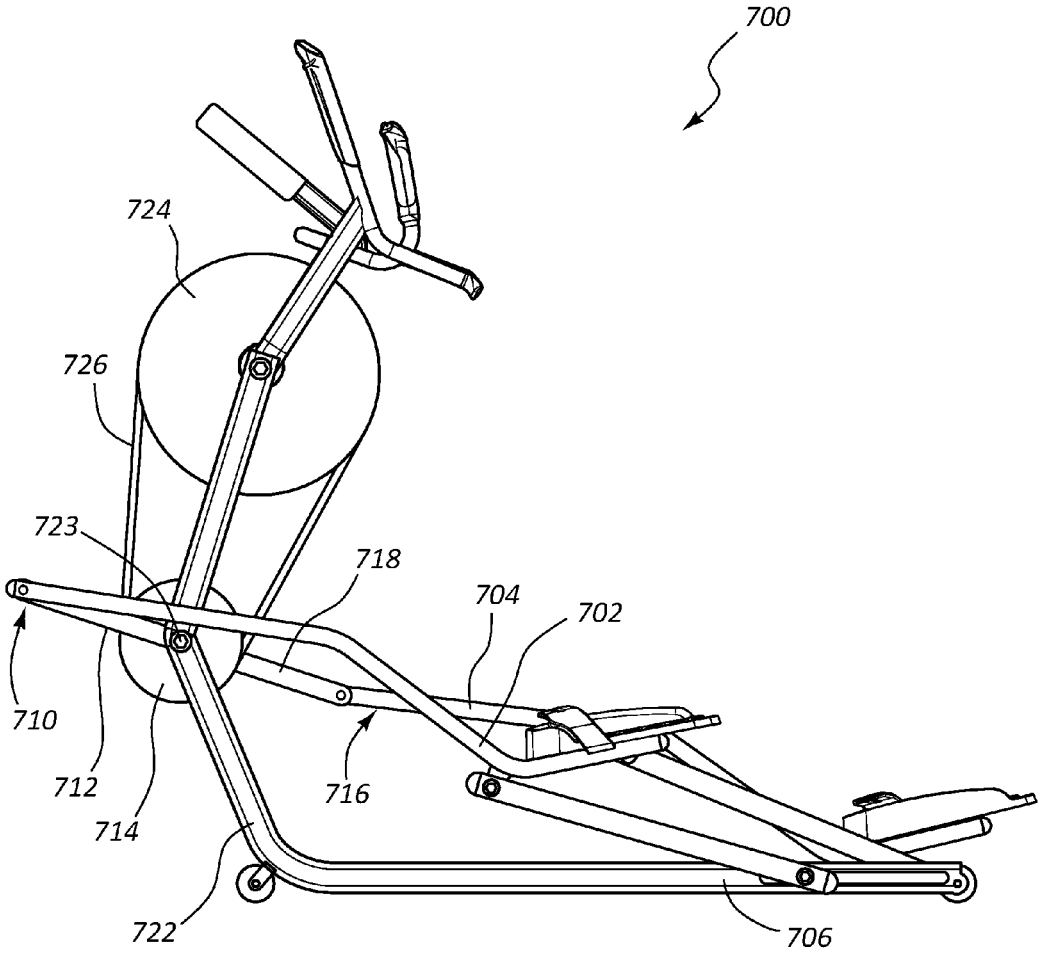
FIG. 7 illustrates a side view of an example of an exercise machine in accordance with the present disclosure.

FIG. 7 depicts an example of an exercise machine 700. In this example, the exercise machine 700 includes a first pedal beam 702 and a second pedal beam 704. The first pedal beam 702 slides along a first track 706, and the second pedal beam 704 slides along a second track. A first crank end 710 of the first pedal beam 702 is pivotally connected to a first crank arm 712 of a crank wheel 714. Likewise, a second crank end 716 of the first pedal beam 702 is pivotally connected to a first crank arm 718 of the crank wheel 714. As the user slides the first and second pedal beams 702, 704 along the first and second track 706, 708, the crank wheel 714 rotates. The first and second crank ends 710, 716 are pivotally connected to a region of the crank wheel 714 and spaced away from crank wheel's axle 723, which causes the first and second crank ends 710, 716 to change the angle and orientation of the first and second pedal beams 702, 704 as the crank wheel 714 rotates. The change in angle and orientation causes the first and second pedal beams 702, 704 to rise and fall as well as move forward and backward during the rotation of the crank wheel 714. Thus, the user's feet travel in an elliptical path as the crank wheel 714 rotates. The first and second tracks 706, 708 are hinged to the exercise machine's frame 722 so the track can rise and fall as the first and second pedal beams 702, 704 rise and fall.

The crank wheel 714 is connected to a flywheel 724 though a belt 726. The flywheel 724 is connected to the frame 722 and is positioned above the crank wheel 714.

In the depicted example, the exercise machine 700 also includes arm supports 728. These arm supports 728 are integral to the frame 722 and do not rotate based on the rotation of the crank wheel 714.

Figure 8:
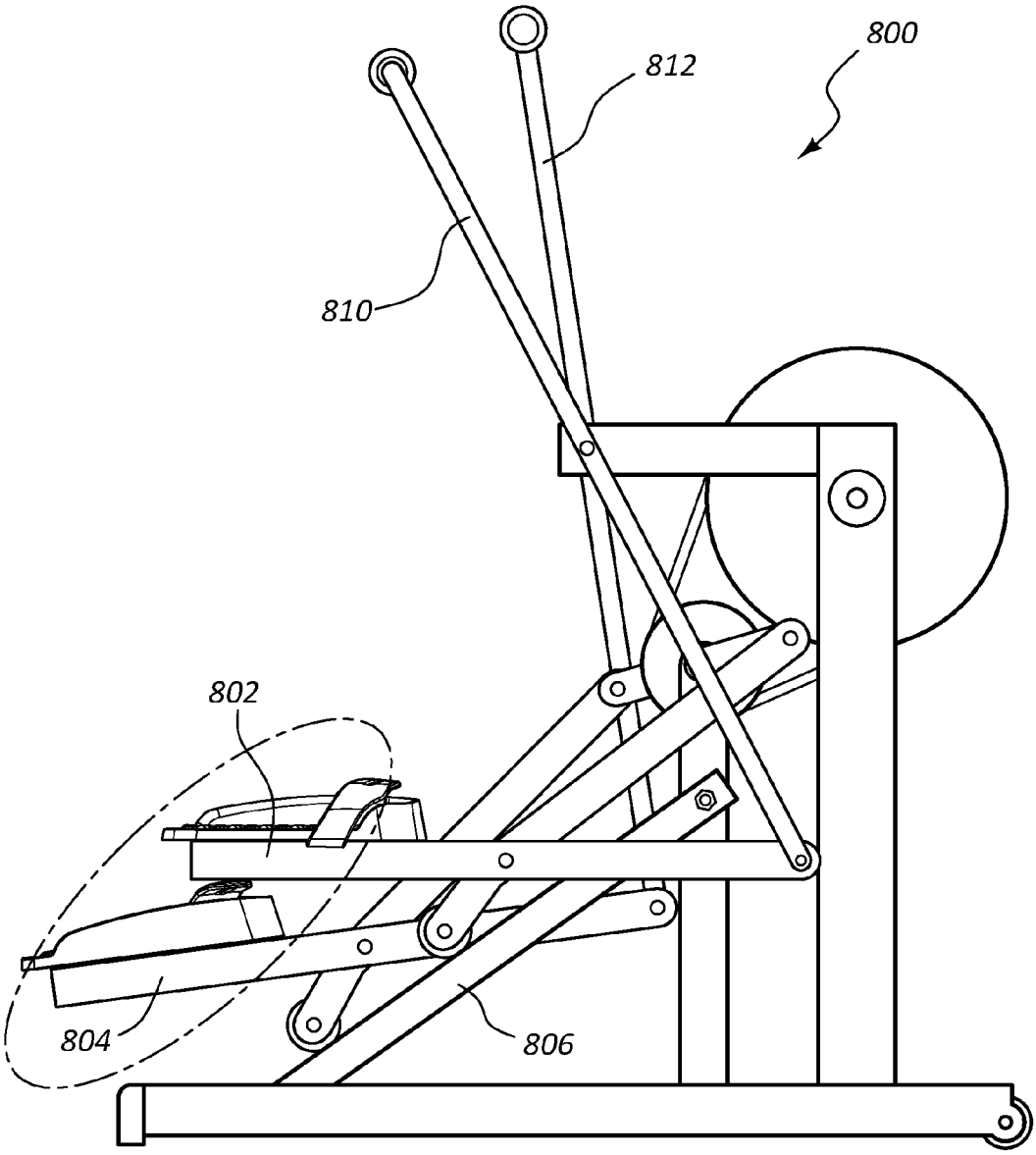
FIG. 8 illustrates a side view of an example of an exercise machine in accordance with the present disclosure.

FIG. 8 depicts an example of an exercise machine 800 that has a first pedal beam 802 and a second pedal beam 804. The first pedal beam 802 slides along a first inclined track 806, and the second pedal beam 804 slides along a second inclined track. In this example, the first and second inclined tracks are fixed in place and do not move and the first and second pedal beams 802, 804 move vertically as they travel along the first and second inclined tracks 806, 808. The first and second inclined tracks in conjunction with the crank wheel 809 cause the path of the pedal beams 802, 804 to form an elliptical shape with a vertical major axis and a horizontal minor axis.

A first support arm 810 is connected to the first pedal beam 802, and a second support arm 812 is connected to the second pedal beam 804. Thus, the first and second support arms 810, 812 move as the user causes the first and second pedal beams 802, 804 to move.

Figure 9:
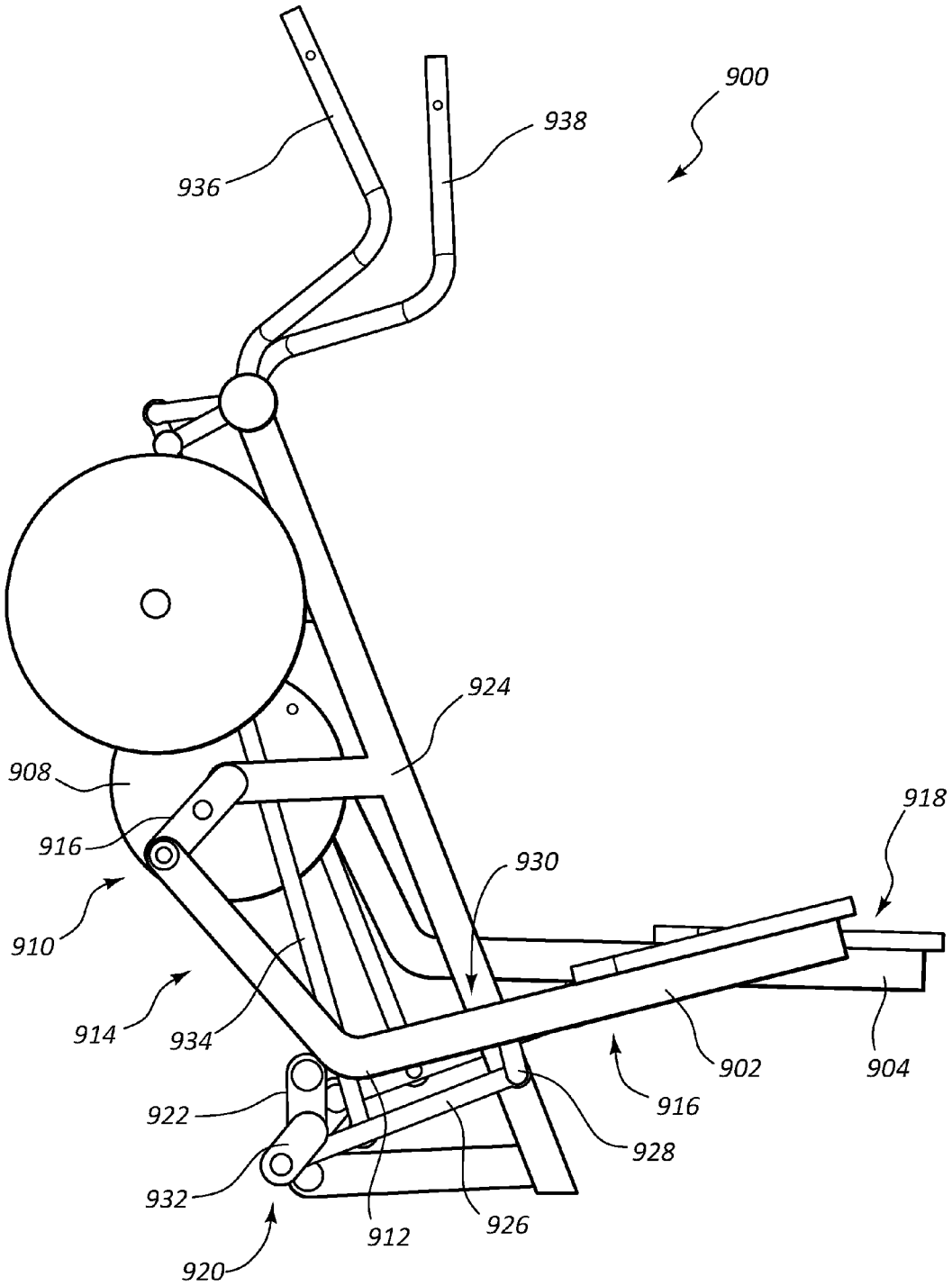
FIG. 9 illustrates a side view of an example of an exercise machine in accordance with the present disclosure.

FIG. 9 depicts an example of an exercise machine 900 with a first pedal beam 902 and a second pedal beam 904. Each of the first and second pedal beams 902, 904 are connected to separate crank arms 906 that connect the first and second pedal beams 902, 904 to a crank wheel 908. The rotation of the crank wheel 908 controls the path that the first ends 910 of the pedal beams 902, 904 travel. In this example, the first and second pedal beams 902, 904 each include a bend 912 such that a crank side 914 of the pedal beams 902, 904 is angled with respect to a pedal side 916 of the pedal beams 902, 904. The angle of the bend 912 causes the free end 918 of the pedal beams 902, 904 to change angle during the revolution of the crank wheel 908 such that free ends 918 travel higher at the peak of an elliptical path than the free ends 918 would otherwise travel and such that the free ends 918 travel lower at the trough of the elliptical path than the free ends 918 would otherwise travel.

A linkage assembly 920 connects the pedal beams 902, 904 to a fixed location 922 of the frame 924. In this example, a first linkage member 926 connects to the underside 928 of a midsection 930 of the pedal side 916 of the first pedal beam 902. The first linkage member 926 is connected to a second linkage member 932 at a pivot. The second linkage member 932 connects to the fixed location 922 of the frame 924. Arm linkage members 934 connect along the length of the first linkage member 926 and control the movement of the first arm support 936 and the second arm support 938.

Figure 10:
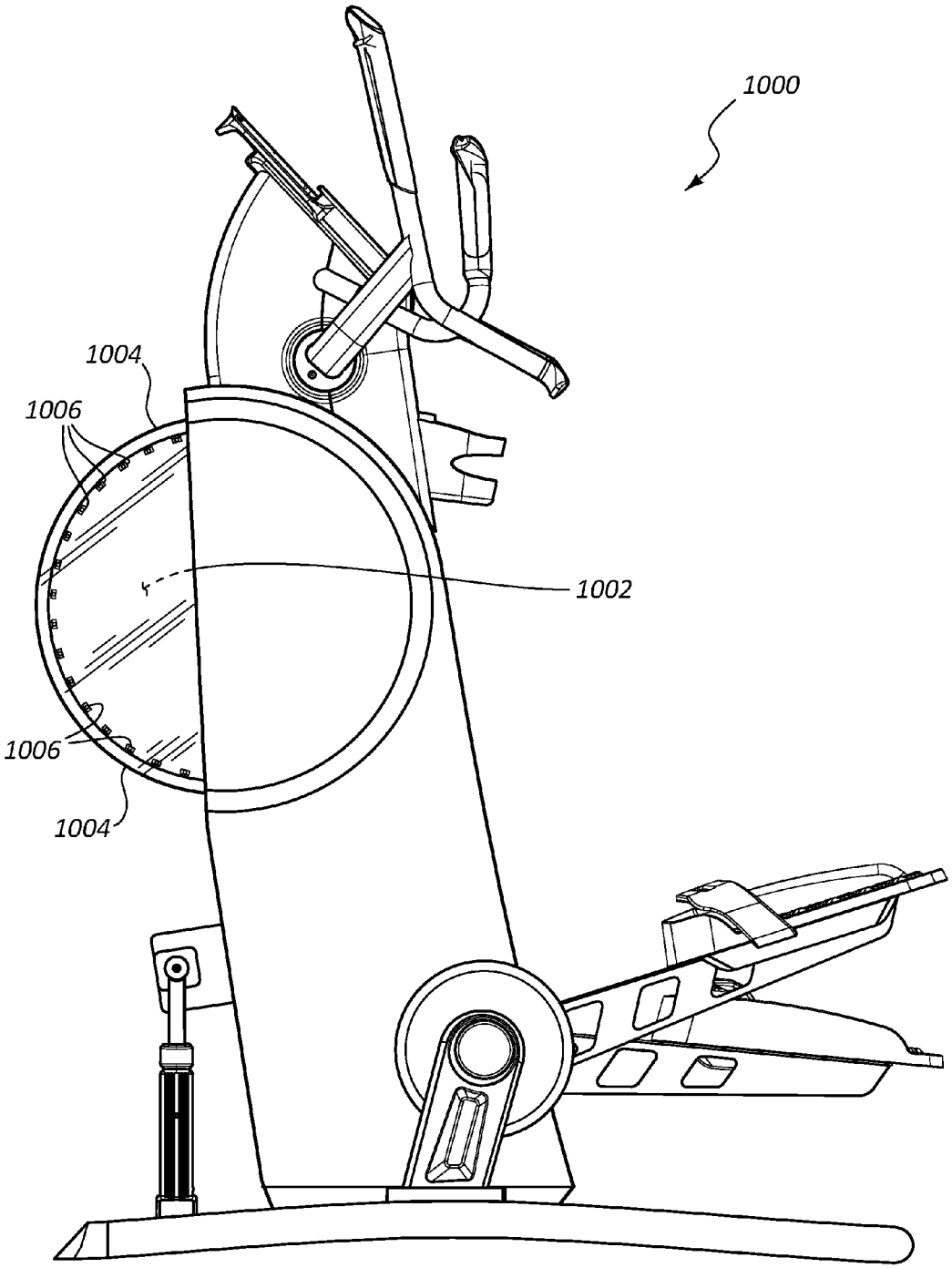
FIG. 10 illustrates a perspective view of an example of an exercise machine in accordance with the present disclosure.

FIG. 10 depicts an example of an exercise machine 1000 with a flywheel 1002 exposed through the outer cover 1004. In this example, the flywheel 1002 includes at least one illuminated feature 1006 (i.e. light emitting diode, light bulb, colored lights, etc). As the user works out on the exercise machine 1000, the flywheel 1002 rotates. The illuminated feature 1006 may create a pleasing appearance to the user as the flywheel 1002 rotates. Achieving such a pleasing appearance may motivate the user to workout at an appropriate intensity level.

While the examples above have been described with various members, angles, connection points, and components, any appropriate type and orientation of the members, angles, connection points, component and so forth may be used in accordance with the principles described herein. Thus, the embodiments above manifest just some of the examples of the invention and do exclusively depict all possible embodiments of the invention.

GENERAL DESCRIPTION OF THE INVENTION

In general, the invention disclosed herein may provide the user with an exercise machine that provides a natural feel as the user moves the pedals. The natural feel is accomplished in part by controlling the movement of the pedal to follow an elliptical path with a vertical major axis and a horizontal minor axis, which may be in contrast to arcuate paths typically achieved with vertical stepping machines. Additionally, the natural feel may be achieved in part by changing the tilt angle of the pedal throughout the elliptical path. Such tilt angle changes may be accomplished by tilting the free end of the pedal beams upward proximate the peak of the elliptical path and tilting the free end of the pedal beams downward proximate a trough of the elliptical path.

Also, the invention disclosed herein may provide the user with an exercise machine that has a smaller footprint and may be easier to manufacture because the rotary resistance mechanism may be positioned vertically above the crank wheel when the exercise machine is in an upright position. By locating the flywheel or other type of rotary resistance mechanism above the crank wheel, the linkage assembly can be simplified and more compact than in conventional exercise machines, like vertical stepper machines.

In some examples, the exercise machine includes a first pedal beam and a second pedal beam. Pedals are attached to free ends of each of the first pedal beam and the second pedal beam. A user can position his or her feet on the pedals. The opposite end of the pedal beam may be connected to a crank wheel that causes the first and second pedal beams to move in a reciprocating movement with respect to each other. For example, when the user applies a force to push down the first pedal, the first pedal beam moves causing the crank wheel to rotate. The rotation of the crank wheel causes the second pedal beam to be moved in an upward direction. Thus, the pedal beams generally move in opposing vertical directions to each other. The crank wheel may define the rise and fall of the pedal beams. In other words, the crank may define a vertical major axis of an elliptical path traveled by the pedals. A linkage assembly may control the horizontal minor axis of the elliptical path traveled by the pedal beams.

The linkage assembly may control the fore and aft movement of the pedals based on the length and orientations of its linkage members. In some examples, the linkage assembly includes a first linkage member and a second linkage member. The first linkage member may be connected to the pedal beam. The second linkage member may be connected to the first linkage member at a first end and a fixed frame location of the frame at a second end. As the crank wheel moves, the first and second members of the linkage assembly also move. However, the movement of the second linkage member may be restricted because the second linkage member is connected at an end to the frame. The restricted movement of the second linkage member also restricts the movement of the first linkage member and causes the first linkage member to be angled in ways that it would not otherwise be angled, but for the fixed end of the second linkage member. In some examples, the first linkage members are rigidly connected to the pedal beams at rigid connections, the pedal beams take on the same angle as the first linkage members causing the pedal beams to change tilt angles continuously along the elliptical path traveled.

In some examples, the second linkage member does not complete a full rotation. Instead, the second linkage member switches between a forward angle and rearward angle. In such an example, the second linkage member approaches the maximum forward angle as its respective crank arm approaches its forward most position. Similarly, the second linkage member approaches the maximum rearward angle as its respective crank arm approaches its rearward most position. As the second linkage member swings back and forth between the forward most angle and the rearward most angle, the second linkage member continuously changes the position of the pivot that connects the first linkage member to the second linkage member along an arcuate path. The angle of the first linkage member may be determined by the combined positions of the pivot between the first and second linkage members and the pivot between the first linkage member and its respective crank arm.

In those examples where the first linkage member and the pedal beam are fixed with respect to each other, the first linkage member and the pedal beam are a single lever with the connection to the crank arm as the fulcrum. As the angle of the first linkage member changes, so does the angle of the pedal beam. In some instances, the axial length of the first linkage member and the pedal beam form an angle with respect to each other. In some instances, such an angle may be between 10.0 and 45.0 degrees.

The length of the first linkage member also determines the location of the pivot between the first and second linkage members. Varying the length of the first linkage member may vary the range of angles that the first linkage member moves between.

The crank wheel may be positioned below the rotary resistance mechanism and may be in communication with the rotary resistance mechanism through a transmission. The transmission may include a transmission belt, a transmission chain, another type of transmission media, or combinations thereof that connects the rotary resistance mechanism, such as a flywheel, to the crank wheel. In some examples, multiple intermediate crank wheels and transmission medium cooperatively connect the rotary resistance mechanism to the crank wheel. The transmission may connect to a flywheel axle or to an outer surface of the flywheel. Likewise, another end of the transmission may connect directly to an axle of the crank wheel or to another portion of the crank assembly in communication with the crank wheel's axle.

As the user moves the pedal beams of the first and second pedal assemblies, the crank assembly causes the crank wheel to rotate. The flywheel moves with the rotation of the crank wheel through the transmission media. Thus, as the resistance is increased to rotate the flywheel, the resistance may be transmitted to the movement of the crank wheel through its axle and thereby to the movement of the pedal beams.

In some examples, the rotation of the flywheel, and therefore the rotation of the crank wheel and the pedal beams, may be resisted through with a magnetic force. Such a magnetic force may be imposed on the flywheel from a magnetic unit that may be adjacent the flywheel. The magnetic unit may be movable with respect to the flywheel. In such examples, the magnetic resistance on the flywheel may be changed by moving the magnetic unit with respect to the flywheel. In other examples, the magnetic force from the magnetic unit can be altered with varying amounts of electrical power. In these examples, the amount of magnetic resistance imposed on the flywheel may be varied by altering the amount of electrical power supplied to the magnetic unit.

Additionally, while the examples above have been described with a single flywheel, any appropriate number of flywheels may be used in accordance with the present disclosure. For example, the exercise machine may incorporate a single flywheel, two flywheels, more than two flywheels, an even number of flywheels, an odd number of flywheels, or combinations thereof.

In conventional stepper machines, the flywheel is placed low to keep the vertical stepper machine's center of gravity closer to the ground. However, in accordance to the principles described herein, the flywheel or other type of rotary mechanism may be positioned high enough on the vertical stepper machine to be positioned over the crank. By positioning the crank wheel and the linkage assembly in the space that is conventionally occupied by the flywheel, the first and second linkage members can be oriented to cause the free ends of the pedal beams to travel along the elliptical path with the appropriate tilt angles as described above.

In some examples, the rotary resistance mechanism includes at least one fan blade. Such a fan blade may be positioned to travel around a circular path as the crank wheel moves. As the fan blade moves, the air may resist its movement. Such resistance may be transmitted to the crank wheel through the transmission thereby providing greater resistance to the user. In some examples, the fan blade contributes to the resistance already provided to the assembly such as the magnetic resistance mechanisms described above or another type of resistance mechanism. In other examples, the air resistance provided by the fan blade may be the primary mechanism for providing resistance to the user's workout. In those examples that utilize the fan blade, at least some of the air displaced through the fan blade can be directed towards the user. In those examples where the rotary resistance mechanism is positioned over the crank wheel, the fan blade may be positioned closer to the user and may be directed to the user to provide cooling.

In some examples, the rotary resistance mechanism may be visible to the user through the outer covering. In such examples, an opening of the outer covering leaves the rotary resistance mechanism exposed to the environment outside of the outer covering. In other examples, a transparent window of the outer covering reveals the rotary resistance mechanism to the user. With the rotary resistance mechanism positioned higher in the exercise machine, the user may derive a benefit from having the rotary resistance mechanism closer to him or her. For example, the user may be able to see patterns in the rotary resistance mechanism as it rotates. For example, an image depicted on the face of a flywheel may present an enjoyable or interesting pattern as the flywheel rotates that the user may see during the workout. Such a pattern may motivate the user to work out at a desired intensity. In other examples, an illuminated feature (i.e. light emitting diodes) may be incorporated into the rotary resistance mechanism. As the rotary resistance mechanism rotates, the illuminated features may also present a pattern that motivates the user. In other examples, the user may feel vibrations from the movement of a flywheel in the rotary resistance mechanism which may provide a tactile feedback to the user about the work that the user is performing and thereby motivate the user.

The exercise machine may include a first arm support and a second arm support that moves along an arcuate path as the user moves the pedal beams with his or her feet. In some examples, a first arm support may be pivotally connected to first linkage member. In such an example, the first arm support may be transversely oriented with respect to the first linkage member. The arm linkage member may be attached to any portion of the first linkage member. In some examples, the arm linkage member may be attached to a region of the member that is proximate the attachment to the crank arm. In other examples, the arm linkage member may be attached to a mid-region of the first linkage member.

The arm linkage member may connect to another arm linkage member at a pivot. In some examples, the first arm linkage member may be three to four times longer than the second arm linkage member. The first arm linkage member may move as the crank wheel moves. In such examples, the first arm linkage member may control the angle of the second arm linkage member. The movement of the second arm linkage member causes the arm supports to move along the arcuate path.

The exercise machine may also be inclined or declined to adjust the intensity of the user's workout. In some examples, the frame of the exercise machine may be supported off of the ground by a central axle that connects to a base of the exercise machine through a first and second post. The angular orientation of the exercise machine's frame about the central axle may be controlled by at least one extendable member that is also connected to both the frame and the base. In some cases, the extendable member may be located at a front of the exercise machine. In such an example, the extension of the extendable member may cause the exercise machine to incline, and the retraction of the extendable member may cause the exercise machine to decline.

Any appropriate type of extendable member may be used in accordance with the principles described in the present disclosure. For example, a screw motor may be used to change the extendable member's length. In other examples, a hydraulic or pneumatic mechanism may be used to cause the extendable member to change its length. Other types of motors, rack and pinion assemblies, magnets, and other types of mechanisms may be used to cause the extendable members to change their length. While this example has been described with reference to the use of extendable members to incline and/or decline the exercise machine, any appropriate mechanism for inclining and/or declining the exercise machine may be used in accordance to the principles described in the present disclosure.

A console may be integrated into the exercise machine. In such examples, the console may be used to control the incline and/or decline of the exercise machine. For example, the user may provide an instruction through a user interface of the console to for a desire incline angle. Signals generated by a processor in communication with the console's user interface may generated a signal to actuators of the extendable member to move in accordance with the inputted instruction to achieve the desired incline angle.

The console may be used to receive other types of instruction from the user. For example, the user may control the resistance level of the exercise machine. In examples where the rotary resistance mechanism is incorporated a magnetic unit, the processor in communication with the console may generate signals that instruct actuators to increase the amount of electric power provided to the magnetic unit and/or to change the position of the magnetic unit to achieve the desired resistance level. In other examples, the user may provide instructions through the console to control a fan blade angle to achieve a different resistance.

Further, the console may be used to request entertainment (i.e. video and/or audio), track a time that the user's workout, track an intensity level, track an estimated number of calories burned, track the time of day, track a user history, track another parameter, or combinations thereof. The console may also be in communication with a remote device (i.e. networked device, data center, website, mobile device, personal computer, etc). In such examples, the console may send and/or receive information with such a remote device. For example, the console may send information to remote devices that operate a fitness tracking program. In such examples, the parameters tracked during the workout may be sent to the remote device so that the fitness tracking program can record and store the parameters of the user's workout. One such examples of a fitness tracking program that may be compatible with the principles described herein can be found at www.ifit.com, which is operated by Icon Health and Fitness, Inc., which is located in Logan, Utah, U.S.A.

While the above examples have been described with reference to using a console to provide instructions to various components of the exercise machine, other mechanisms may be used to control the various aspects of the exercise machine. For example, the user may control at least some aspect of the exercise machine through his or her mobile device. In other examples, another type of remote device may be used to control various aspect of the exercise machine. Further, the exercise machine may be controlled though a speech recognition program, hand gestures, other types of inputs, or combinations thereof.

In some examples, the pedal beams travels along a track. In such an example, a roller may be attached to the underside of the pedal beam. As the crank wheel moves and the pedal beams follow, the roller may be a fulcrum that assists in changing the angle of the pedal beams. In such an example, the flywheel or other type of rotary resistance mechanism may be positioned above the crank wheel to simplify the construction of the linkage assembly.

In some examples, the track may include a tensioned member. The tensioned member may reduce at least some of the jolts often associated with movement of mechanical components. In some examples, a roller may be attached to the pedal beam and the roller contacts the tensioned member. In other examples, the tensioned member may be attached to and may span the underside of the pedal beam. In such an example, the roller may be positioned elsewhere on the exercise machine and used to guide the pedal beam.

While the above examples have been described with a specific number of linkage members in the linkage assembly, any appropriate number of linkages may be used in accordance with the principles described in the present disclosure. For example, the linkage assembly may comprise a single linkage member, two linkage members, three linkage members, or more. Further, the linkage members may be arranged in any appropriate orientation to achieve the elliptical path described above. Further, in some examples, no arm linkage members are connected to the linkage members that are connected to the crank wheel. In such examples, the arm supports may be stationary during the performance of an exercise. In other examples, the arm supports may move based upon the user's arm movement or another type of mechanism.

Further, the first linkage member may be attached to the pedal beam through any appropriate mechanism. For example, the first linkage member and the pedal beam may be welded, bolted, riveted, fastened, or otherwise connected together. In some examples, the pedal beam and the first linkage member are integrally formed with one another.

Any appropriate type of elliptical path may be formed by the pedals of the exercise machine. The elliptical path traveled by the pedals may be different than the type of path followed by a front end of the pedal beam or other components of the linkage assembly. The elliptical path may include a major vertical axis that may be greater than a horizontal minor axis. In some examples, the path followed by the pedal is generally elliptical where a portion of the path may flatten out, form a sharp corner, form a slightly asymmetric elliptical shape, or form another type of movement that does not conform to a mathematically defined elliptical shape. Further, the elliptical path followed by the pedals may include a major axis that may be tilted less than 45.0 degrees with respect to a vertical orientation, less than 35.0 degrees with respect to a vertical orientation, less than 25.0 degrees with respect to a vertical orientation, less than 15.0 degrees with respect to a vertical orientation, less than 5.0 degrees with respect to a vertical orientation, or combinations thereof.

The tilt angle of the pedals at the peak of the elliptical path be an angle that may be less than 45.0 degrees with respect to a vertical orientation, less than 35.0 degrees with respect to a vertical orientation, less than 25.0 degrees with respect to a vertical orientation, less than 15.0 degrees with respect to a vertical orientation, less than 5.0 degrees with respect to a vertical orientation, or combinations thereof. Further, the tilt angle of the pedals at the trough of the elliptical path may be an angle that is less than 45.0 degrees with respect to a vertical orientation, less than 35.0 degrees with respect to a vertical orientation, less than 25.0 degrees with respect to a vertical orientation, less than 15.0 degrees with respect to a vertical orientation, less than 5.0 degrees with respect to a vertical orientation, or combinations thereof.

What is claimed is:

1. A vertical stepping machine, comprising:

a frame;

a crank wheel connected to the frame;

a pedal beam having a first end and a second end, wherein the first end is in mechanical communication with the crank wheel;

a pedal connected to the second end of the pedal beam;

a linkage assembly connected to the frame and to the pedal beam;

an arm support rotatably connected to the frame;

an arm linkage connecting the arm support to the linkage assembly; and a rotary resistance mechanism positioned above the crank wheel when the vertical stepping machine is in an upright orientation, the resistance mechanism being operatively associated with the crank wheel;

wherein the pedal beam is configured to move the pedal in an elliptical path when the crank wheel rotates, the elliptical path having a vertical major axis and a horizontal minor axis when the vertical stepping machine is in an upright position.

2. The vertical stepping machine of claim 1, wherein the rotary resistance mechanism comprises a flywheel.

3. The vertical stepping machine of claim 1, wherein the rotary resistance mechanism comprises at least one fan blade.

4. The vertical stepping machine of claim 1, wherein the linkage assembly comprises:

a first linkage member fixedly connected to the pedal beam; and a second linkage member connected on a first end to the first linkage member at a pivot, and connected on a second end to the frame at a fixed frame location.

5. The vertical stepping machine of claim 4, wherein the first linkage member is longer than the second linkage member.

6. The vertical stepping machine of claim 4, wherein the pedal beam is positionally fixed relative to a first linkage member of the linkage assembly.

7. The vertical stepping machine of claim 6, wherein the arm linkage connects along a length of the first linkage member at a pivot connection; and wherein the arm linkage member is transverse to the first linkage member.

8. The vertical stepping machine of claim 1, further comprising:

an inclined track connected to the frame; and a roller connected to an underside of the pedal beam;

wherein the roller rides along the inclined track as the pedal beam moves along the elliptical path.

9. The vertical stepping machine of claim 1, wherein the frame is rotatably connected to a base structure.

10. The vertical stepping machine of claim 9, further comprising an axial extension member connected to the base structure on a first end and to the frame on a second end;

wherein variation in length of the axial extension member along a longitudinal axis of the axial extension member changes an incline of the vertical stepping machine.

11. The vertical stepping machine of claim 1, wherein the rotary resistance mechanism comprises at least one illuminated feature.

12. A vertical stepping machine, comprising:

a frame;

a crank wheel connected to the frame;

a pedal beam having a first end and a second end, wherein the first end is in mechanical communication with the crank wheel;

a pedal connected to the second end of the pedal beam;

a linkage assembly connected to the frame and to the pedal beam;

an arm support rotatably connected to the frame; an arm linkage connecting the arm support to the linkage assembly;

wherein the linkage assembly comprises a first linkage member, and a second linkage member connected to the first linkage member at a pivot;

wherein the first linkage member connects to the pedal beam and the second linkage member connects to the frame at a fixed frame location;

wherein the pedal beam is positionally fixed relative to the first linkage member;

a rotary resistance mechanism positioned above the crank wheel when the vertical stepping machine is in an upright orientation, the resistance mechanism being operatively associated with the crank wheel;

wherein the pedal beam is configured to move the pedal in an elliptical path when the crank wheel rotates, the elliptical path having a vertical major axis and a horizontal minor axis when the vertical stepping machine is in an upright position.

13. The vertical stepping machine of claim 12 wherein the rotary resistance mechanism comprises a flywheel.

14. The vertical stepping machine of claim 12, wherein the rotary resistance mechanism comprises at least one fan blade.

15. The vertical stepping machine of claim 12, further comprising:

an inclined track connected to the frame; and a roller connected to an underside of the pedal beam;

wherein the roller rides along the inclined track as the pedal beam moves along the elliptical path.

16. The vertical stepping machine of claim 12, wherein the arm linkage member connects along a length of the first linkage member at a pivot connection and is transverse to the first linkage member.

17. The vertical stepping machine of claim 12, wherein the frame is rotatably connected to a base structure.

18. The vertical stepping machine of claim 17, further comprising an axial extension member that connects to the base structure and to the frame, wherein the axial extension member is configured to change an incline of the vertical stepping machine when the axial extension member is actuated to change its longitudinal axis.

19. The vertical stepping machine of claim 12, wherein the rotary resistance mechanism comprises at least one illuminated feature.

20. A vertical stepping machine, comprising:

a base;

a frame rotatably connected to the base;

a crank wheel connected to the frame;

a pedal beam having a first end and a second end, wherein the first end is in mechanical communication with the crank wheel;

a pedal connected to the second end of the pedal beam;

a linkage assembly connected to the frame and to the pedal beam, wherein the linkage assembly includes a first linkage member fixedly connected to the pedal beam, and a second linkage member connected on a first end to the first linkage member at a pivot, and connected on a second end to the frame at a fixed frame;

wherein the pedal beam and the first linkage member are fixed with respect to one another;

a rotary resistance mechanism positioned above the crank wheel when the vertical stepping machine is in an upright orientation, the resistance mechanism being operatively associated with the crank wheel;

at least one illuminated feature incorporated into the rotary resistance mechanism;

an axial extension member connected to the base structure and to the frame, wherein the axial extension member is configured to change an incline of the vertical stepping machine when the axial extension member is actuated to change its longitudinal axis; and an arm linkage member connected to the first linkage member along a length of the first linkage member at a pivot connection, wherein the arm linkage member is transverse to the first linkage member;

the arm support rotatably connected to the frame;

the arm linkage connecting the arm support to the linkage assembly;

wherein the pedal beam moves in an elliptical path when the crank wheel rotates, the elliptical path having a vertical major axis and a horizontal minor axis when the vertical stepping machine is in an upright position.

* * * * *